US008851632B2

(12) United States Patent
Ota et al.

(10) Patent No.: US 8,851,632 B2
(45) Date of Patent: Oct. 7, 2014

(54) RECORDING APPARATUS

(71) Applicant: Seiko Epson Corporation, Tokyo (JP)

(72) Inventors: Hidenobu Ota, Hara-mura (JP); Makoto Kiuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/841,463

(22) Filed: Mar. 15, 2013

(65) Prior Publication Data

US 2013/0278680 A1 Oct. 24, 2013

(30) Foreign Application Priority Data

Apr. 19, 2012 (JP) ..... 2012-095852

(51) Int. Cl.
*B41J 2/14* (2006.01)
*B41J 19/00* (2006.01)

(52) U.S. Cl.
CPC . *B41J 2/14* (2013.01); *B41J 19/005* (2013.01)
USPC ..... 347/50

(58) Field of Classification Search
CPC ..... B41J 2/14072; B41J 2/14491; B41J 2/17526; H05K 2201/053
USPC ..... 347/50
See application file for complete search history.

(56) References Cited

U.S. PATENT DOCUMENTS

| | | | | |
|---|---|---|---|---|
| 6,726,309 | B2 | 4/2004 | Maki | |
| 6,755,514 | B2 | 6/2004 | Koga | |
| 6,834,938 | B2 | 12/2004 | Maki et al. | |
| 7,063,409 | B2 | 6/2006 | Koga | |
| 7,631,965 | B2 | 12/2009 | Samoto et al. | |
| 7,775,629 | B2 | 8/2010 | Nukui et al. | |
| 7,988,268 | B2 | 8/2011 | Morino | |
| 7,999,186 | B2 | 8/2011 | Sugita | |
| 2003/0107624 | A1* | 6/2003 | Koga | 347/85 |
| 2005/0243130 | A1* | 11/2005 | Essen et al. | 347/50 |

FOREIGN PATENT DOCUMENTS

| | | |
|---|---|---|
| JP | 3-246039 | 11/1991 |
| JP | 10-226084 | 8/1998 |
| JP | 11-157288 | 6/1999 |
| JP | 2000-062283 | 2/2000 |
| JP | 2000-318176 | 11/2000 |
| JP | 2001-171096 | 6/2001 |
| JP | 2002-019227 | 1/2002 |
| JP | 2003-011339 | 1/2003 |
| JP | 2003-175589 | 6/2003 |
| JP | 2003-220740 | 8/2003 |

(Continued)

*Primary Examiner* — Stephen Meier
*Assistant Examiner* — Alexander D Shenderov
(74) *Attorney, Agent, or Firm* — Workman Nydegger

(57) ABSTRACT

A recording apparatus includes a flexible wiring substrate of which one end is connected to a recording head side; and a holding member which holds a plurality of the flexible wiring substrates in a state of being laminated, the holding member has a regulating section which regulates both end portions of the plurality of the flexible wiring substrates in the width direction in a state of being laminated, a first film member which is disposed on one side of the plurality of the flexible wiring substrates and has flexibility, and a second film member which is disposed on the other side in the thickness direction in a state where an interval is secured which is greater than a total thickness of the plurality of the flexible wiring substrates with respect to the first film member and has flexibility.

6 Claims, 8 Drawing Sheets

(56) References Cited

FOREIGN PATENT DOCUMENTS

| | | | | | |
|---|---|---|---|---|---|
| JP | 2004-058452 | | 2/2004 | | |
| JP | 2005-096395 | | 4/2005 | | |
| JP | 2005-186629 | | 7/2005 | | |
| JP | 2005-254684 | | 9/2005 | | |
| JP | 2005-254689 | | 9/2005 | | |
| JP | 2005-329547 | | 12/2005 | | |
| JP | 2006-082381 | | 3/2006 | | |
| JP | 2006-102985 | | 4/2006 | | |
| JP | 2006-123195 | | 5/2006 | | |
| JP | 2006-205741 | | 8/2006 | | |
| JP | 2006-205741 | A * | 8/2006 | ..... | B41J 2/01 |
| JP | 2006-231819 | | 9/2006 | | |
| JP | 2007-176068 | | 7/2007 | | |
| JP | 2008-049560 | | 3/2008 | | |
| JP | 2008-149647 | | 7/2008 | | |
| JP | 2008-290387 | | 12/2008 | | |
| JP | 2009-023169 | | 2/2009 | | |
| JP | 2010-240927 | | 10/2010 | | |

* cited by examiner

RECORDING APPARATUS

BACKGROUND

1. Technical Field

The present invention relates to a recording apparatus.

2. Related Art

In the related art, as an ink jet type recording apparatus, a so-called off-carriage type recording apparatus has been known in which an ink receiving body provided in an ink cartridge is connected to a recording head provided on a lower surface of a carriage via an ink supply tube. In such an off-carriage type recording apparatus, the ink supply tube may be moved irregularly following reciprocation of the carriage. Then, a liquid ejecting apparatus has been known in which one end of a steel belt disposed to overlap the ink tube is fixed to a stationary portion facing the carriage running path and the other end of the ink tube is connected to the carriage (see, for example, JP-A-2006-102985).

However, in such an off-carriage type recording apparatus, a configuration is adapted to draw out the wiring such as Flexile flat cables (FFC) on the rear surface of the recording head and the carriage on which the recording head is mounted in order to perform reduction of the size.

Since the FFC has a structure in which a plurality of wirings are laminated, the plurality of the wirings are required to be formed for supply of the power and for transmitting and receiving of signal with respect to the recording head or a detector for detecting the width of the paper or the like. Thus, when the recording head reciprocates as described above, deviation occurs between the plurality of the FFCs so that crosstalk occurs between the wirings of each FFC and there is a concern that malfunction of the carriage body, the recording head or detectors may be caused. Then, as disclosed in JPA-2006-102985, a configuration may be considered in which a plurality of the FFCs are held by being laminated and fixed to the carriage.

However, when the plurality of the FFCs are fixed to the carriage by being laminated as described above, since the plurality of the FFCs cannot be smoothly bent while the carriage reciprocates, there is a concern that the movement of the carriage is interfered and the recording process cannot be stably performed.

SUMMARY

An advantage of some aspects of the invention is to provide a recording apparatus having high reliability in which communication of electric signal and supply of the power are stably performed and occurrence of operation failure is prevented.

According to an aspect of the invention, there is provided a recording apparatus which performs recording by a recording head mounted on a carriage which is capable of scanning with respect to a recording medium, including: a flexible wiring substrate of which one end is connected to the recording head side and which transmits an electric signal between a controller performing control of the recording head and the recording head; and a holding member which holds a plurality of the flexible wiring substrates in a state of being laminated, wherein the holding member has a regulating section which regulates both end portions of the plurality of the flexible wiring substrates in the width direction in a state of being laminated, a first film member which is disposed on one side of the plurality of the flexible wiring substrates in the thickness direction in a state of being laminated and has flexibility, and a second film member which is disposed on the other side in the thickness direction in a state where an interval is secured which is greater than a total thickness of the plurality of the flexible wiring substrates with respect to the first film member and has flexibility.

According to the recording apparatus of the aspect of the invention, the holding member can hold the plurality of the flexible wiring substrates between the first film member and the second film member by being sandwiched. In the plurality of the flexible wiring substrates held in the holding member, deviation of the position in the width direction is regulated by the regulating section. Accordingly, in the wiring formed on each of the flexible wiring substrates, deviation of the position in the width direction does not occur and occurrence of the crosstalk can be prevented. Accordingly, the flexible wiring substrate can stably perform the communication of the electric signal and supply of the power with respect to the recording head side.

In addition, since the second film member is disposed in a state where an interval is secured which is greater than a total thickness of the plurality of the flexible wiring substrates with respect to the first film member, an interval can be generated between the laminated flexible wiring substrates when the plurality of the flexible wiring substrates, for example, are bent during the scanning of the recording head. There is no force to cause regulation on the long side direction of the flexible wiring substrates during bending. Accordingly, even if difference in an inner race and an outer race between the laminated flexible wiring substrates occurs, since restriction between each of the flexible wiring substrates does not occur in the long side direction, the flexible wiring substrates can be bent without distortion being caused.

Accordingly, the recording apparatus having high reliability can be supplied in which communication of the electric signal and the supply of the power are stably performed, and the failure of the bending operation of the flexible wiring substrate is prevented from occurring.

In the recording apparatus, the regulating section may be formed in any of the first film member or the second film member.

According to the configuration, since the regulating section is formed in any of the first film member or the second film member, the number of the parts is reduced and assembling characteristics can be improved, and low cost can be realized.

In the recording apparatus, the regulating section may be configured of a pair of belt members, and the pair of the belt members may integrate the first film member and the second film member by being engaged each other.

According to the configuration, since the first film member and the second film member can be easily integrated by being engaged each other, the number of the parts is reduced and assembling characteristics can be improved, and low cost can be realized.

In the recording apparatus, the flexible wiring substrates may come into contact with the recording head in a state of having a bending section which is bent in the thickness direction.

According to the configuration, since the flexible wiring substrates has the bending section, as described above, the advantage is securely obtained that the flexible wiring substrates can be bent without distortion being caused.

In the recording apparatus, the flexible wiring substrates may be bent in the vertical direction in the bending section.

According to the configuration, the flexible wiring substrates can be easily bent by setting the bending direction of the bending section in the vertical direction in which the flexible wiring substrates are easily deflected in the vertical direction by its own weight. Accordingly, since the bending characteristics of the flexible wiring substrates connected to the recording head is improved, the scanning of the carriage can be smoothly carried out.

In the recording apparatus, the first film member and the second film member may configure a film body by sandwiching the flexible wiring substrates, and the film body may be attached to a recording apparatus body in a state where one end side thereof is supported to be fixed to the carriage and the other end side thereof is movable along the longitudinal direction of the film body.

According to the configuration, since the other end side of the film body is movable along the longitudinal direction, the vibration occurred due to the bending movement of the flexible wiring substrates can be suppressed in being transmitted to the recording head side compared to a configuration in which the film body itself is completely fixed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiment of the invention will be described with reference to the drawings. In addition, in each of the drawings, in order to make the size of each member to a recognizable degree, each member has a different scale. In the embodiment, a printing apparatus is applied to a large printer which can perform printing on a printing paper having a width up to A1 or B1 size.

Figure 1:
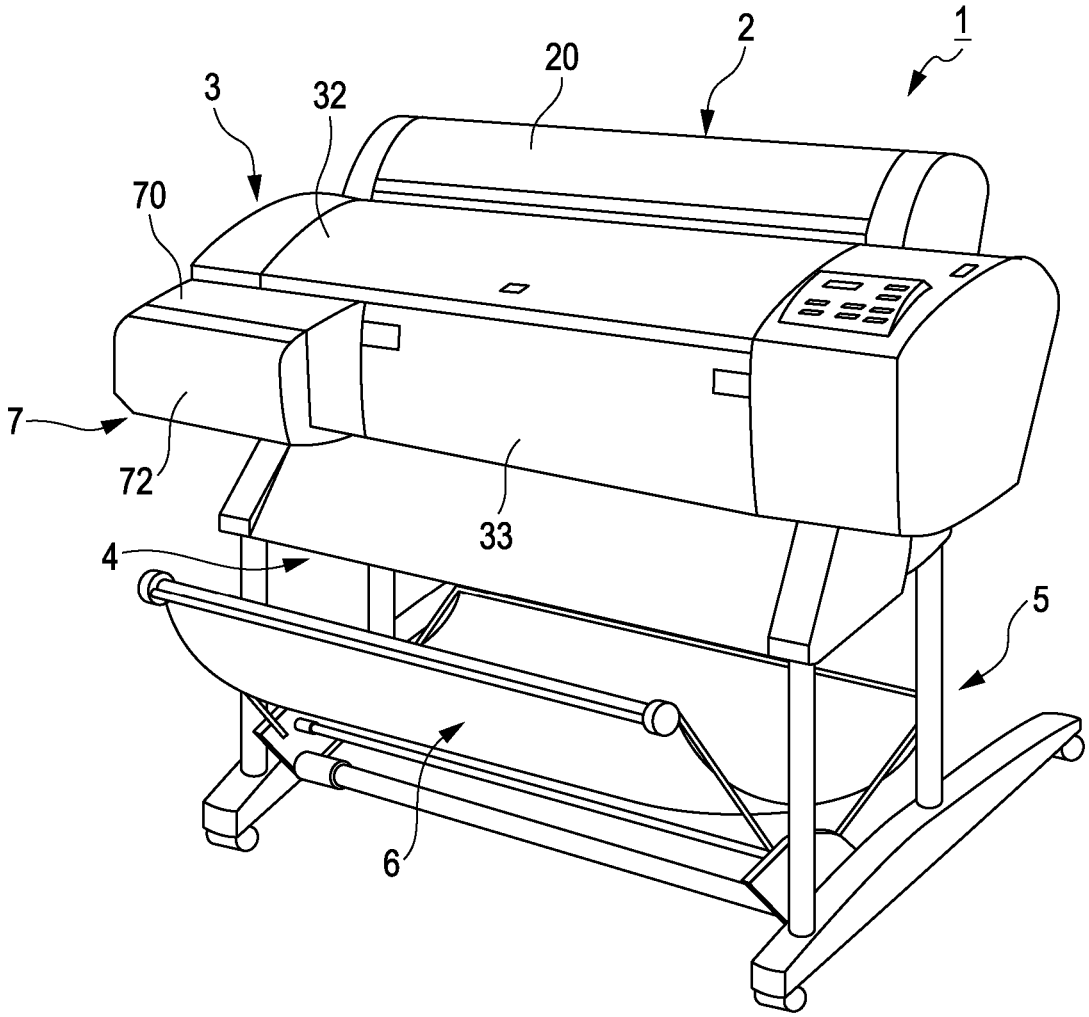
FIG. 1 is a view illustrating a perspective configuration of a printer according to an embodiment.
Figure 2:
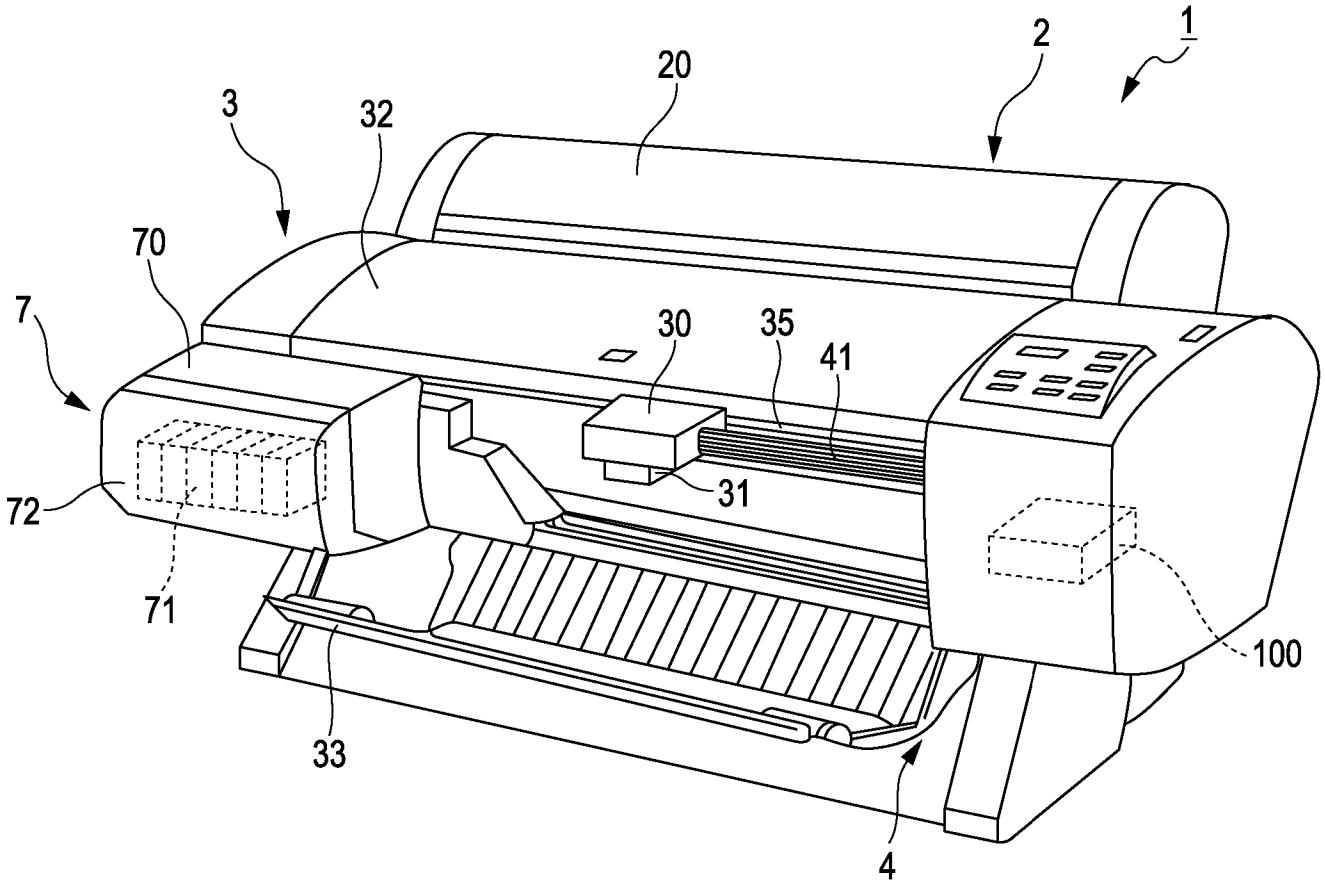
FIG. 2 is a perspective configuration view illustrating a state where a front cover of the printer is opened.

FIG. 1 is a view illustrating a perspective configuration of the printer according to the embodiment and FIG. 2 is a perspective configuration view illustrating a state where a front cover of the printer is opened.

The printer 1 includes a paper feeding section 2, a printing section 3 and a paper discharging section 4 which configure a printer body, a leg device 5 and a discharged-paper receiving device 6. The paper feeding section 2 is provided to protrude in an upward direction from the rear side of printer 1 and there is a roll paper (a recording medium) in the inside thereof. A roll paper cover 20 is attached to be opened or closed to cover the roll paper.

The printing section 3 has an upper cover 32 and a front cover 33. The printing section 3 has a carriage 30, on which a printing head 31 is mounted in a space partitioned by the upper cover 32 and the front cover 33. An ink tube 41 is connected to the printing head 31 mounted on the carriage 30. The printing head 31 is configured of a so-called ink jet head in which a plurality of nozzles for ejecting the ink supplied via the ink tube 41 are formed.

The front cover 33 is configured such that the lower portion thereof positioned on a paper transportation side is rotatably supported on the apparatus body. The carriage 30 is supported to be movable along a rail 35 provided in the main scanning direction. The carriage 30 is adapted to reciprocate being guided by the rail 35 when a carriage driving device (not illustrated) is actuated.

Figure 3:
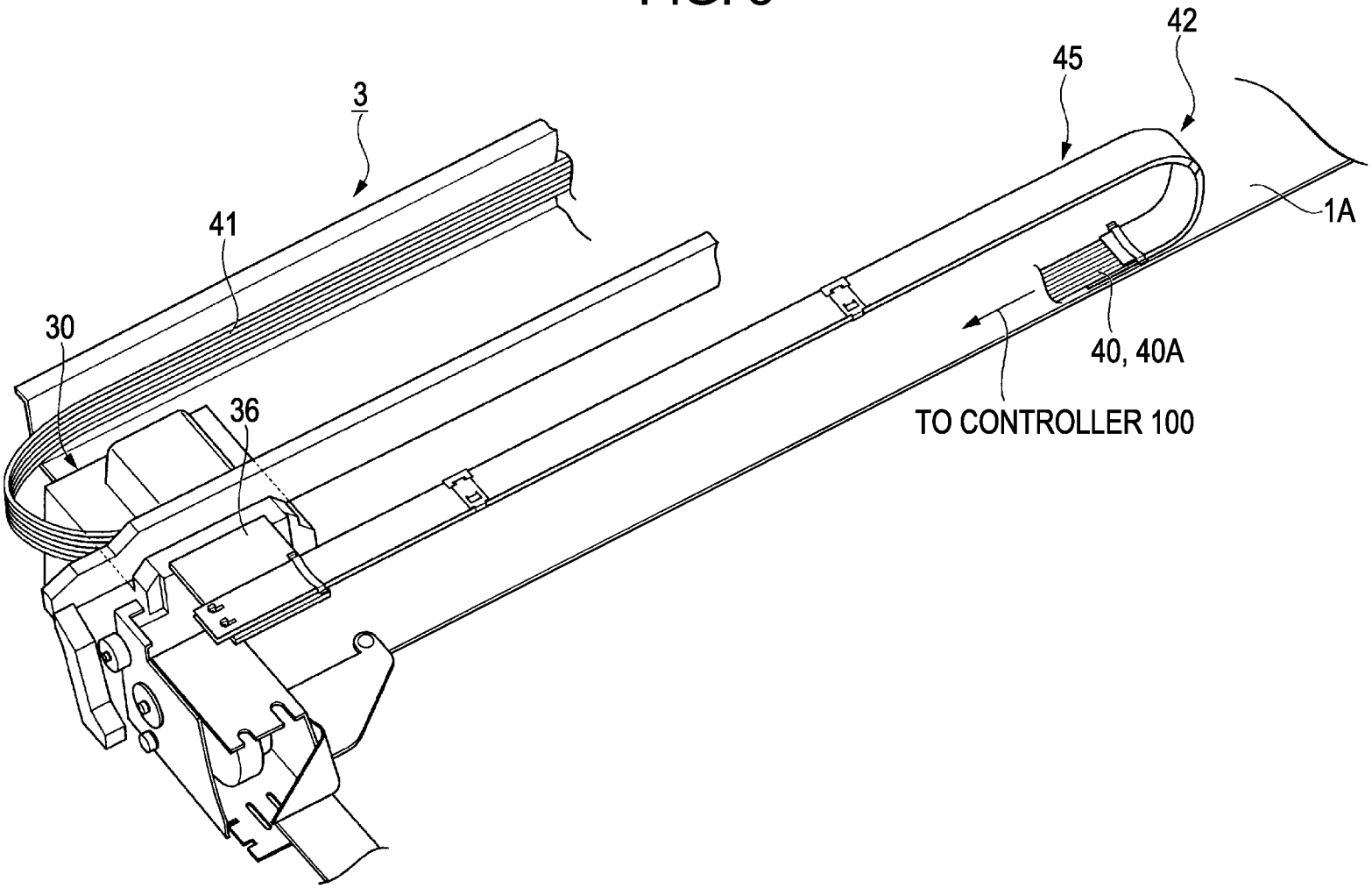
FIG. 3 is a view illustrating a configuration of a main portion of a printing section viewed from the rear side of the printer.

FIG. 3 is a view illustrating a configuration of a main portion of the printing section 3 viewed from the rear side of the printer 1. As illustrated in FIG. 3, the carriage 30 and the printing head 31 mounted on the carriage 30 are connected to the ink tube 41 and a plurality of flat cables (a flexible wiring substrate) 40 for transmitting a printing signal from a controller 100 (see, FIG. 2). Each of the flat cables 40 is configured from the long-shaped flexible wiring substrate and has wiring for transmitting various types of signal to the carriage 30 side. In the printer 1 according to the embodiment, one end of a plurality of flat cables 40 which is held in a cable holder (a film body) 45 is connected to the printing head 31. In addition, the other end of the flat cable 40 is connected to a connector of the controller 100 (see, FIG. 2) mounted on a case body section 1A.

A cartridge holder 7 configuring an ink supply device is included in the front side of the printing section 3. Ink cartridges 71 of six colors (yellow, light magenta, light cyan, magenta, cyan and black) are accommodated side-by-side and detachably from the front side of the printer 1 in a holder body 70 of the cartridge holder 7.

A holder cover 72 covering the inserted ink cartridges 71 is provided to be opened or closed in the holder body 70. Each color ink is supplied to the printing head 31 through the ink tube 41 and is used to be printed on the printing paper.

Printing operation of the printer 1 described above is performed such that the print is performed on the roll paper fed from the paper feeding section 2 by the printing section 3 and the roll paper is discharged obliquely downwards on the front side of the printer 1 via the paper discharging section 4. A cutter (not illustrated) for cutting the roll paper is provided between the printing section 3 and the paper discharging section 4. The roll paper is cut by the cutter after the print is finished and is received in the discharged-paper receiving device 6.

Return to FIG. 3 again, one end side of the ink tube 41 is connected to the carriage 30 and the other end side thereof is connected to the ink cartridges 71 by being folded by 180° in the middle thereof. In other words, the ink tube 41 is connected to the carriage 30 side in a state of being bent in the horizontal plane.

Similar to the ink tube 41, one end side of the flat cable 40 is connected to the carriage 30 and the other end side thereof is connected to the printer body by being folded by 180° in the middle thereof, after the flat cable 40 is drawn around along the scanning direction of the carriage 30. In other words, as illustrated in FIG. 3, the flat cable 40 is connected to the carriage 30 side in a state of having a bending section 42 which is bent in the vertical plane. According to the configuration, the flat cable 40 can be easily bent by setting the bending direction of the bending section 42 in the vertical direction in which the flat cable 40 is easily deflected in the vertical direction by its own weight. Accordingly, since the bending characteristics of the flat cable 40 connected to the printing head 31 is improved, the scanning of the carriage 30 can be smoothly carried out.

However, since the flat cable 40 and the ink tube 41 connected to the carriage 30 side move following the reciprocation of the carriage 30 performing along the rail 35, there is a possibility that each of them moves irregularly. Thus, there is a concern that each position of a plurality of the flat cables 40 may be deviated when the carriage 30 reciprocates.

Since the flat cable 40 has the wiring for transmitting various types of signal to the printing head 31, there is a possibility that signal crosstalk occurs between different wirings of the flat cables 40 when the position of the plurality of the flat cables 40 in the width direction (a short axial direction) is deviated.

As described above, when the crosstalk occurs between the plurality of the flat cables 40, since a predetermined signal is not transmitted to the carriage 30, the printing operation is not preferably performed by the printing head 31, or a problem occurs in the operation of the carriage 30 and then print quality is likely to be greatly reduced.

The printer 1 according to the embodiment is provided to prevent the occurrence of the problem described above and, in particular, includes a cable holder 45 which holds the plurality of the flat cables 40 in a state of being laminated.

Figure 4:
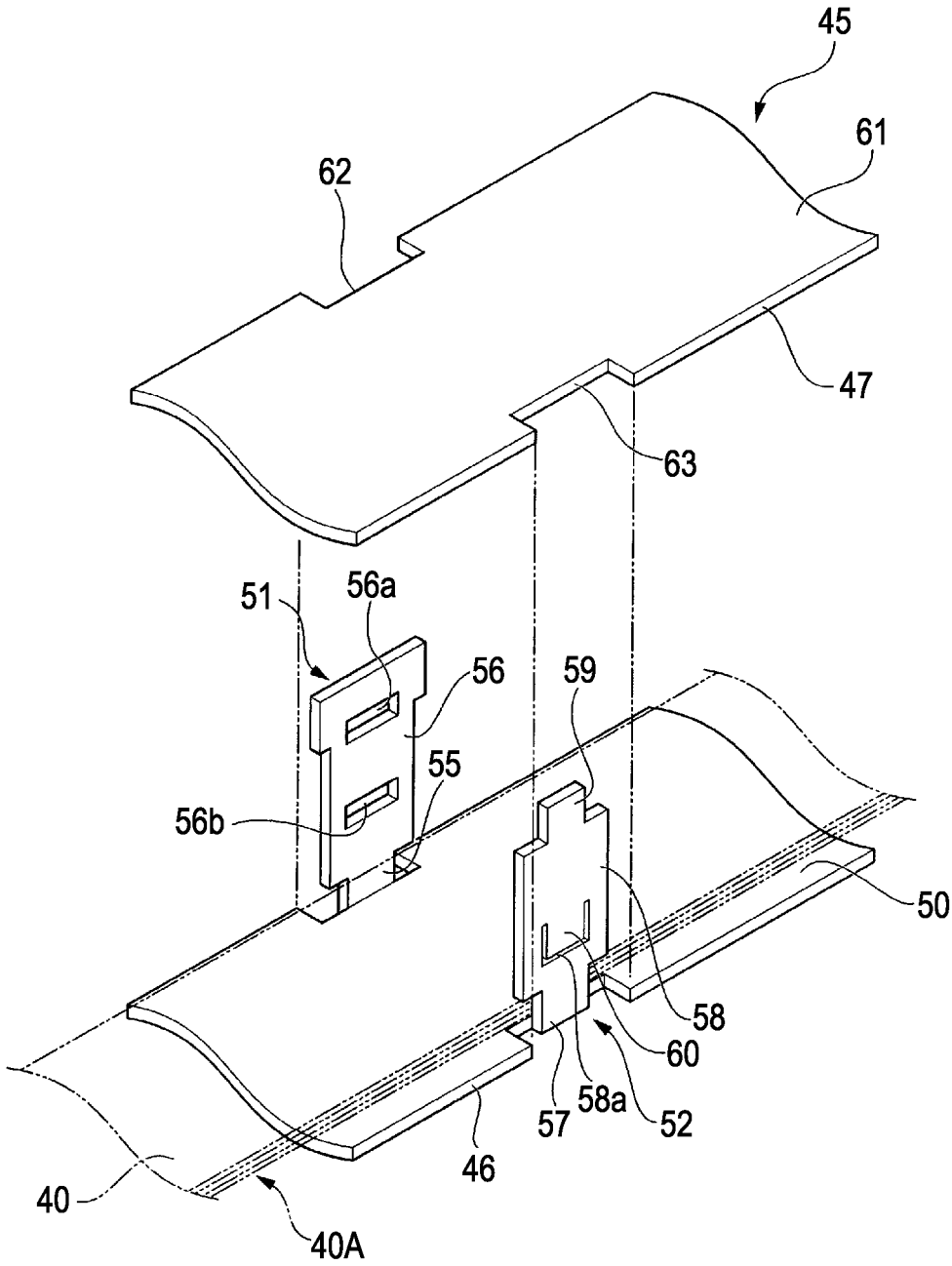
FIG. 4 is a view illustrating exploded perspective configuration of the cable holder.

FIG. 4 is a view illustrating an exploded perspective configuration of the cable holder 45. As illustrated in FIG. 4, the cable holder 45 is configured of a pair of film members, in particular, a first film member 46 and a second film member 47. The second film member 47 is formed longer than the first film member 46. Thus, the both end sections of the second film member 47 are protruded from the both end portions of the first film member 46 in a state where the first film member 46 and the second film member 47 are laminated.

The first film member 46 is configured of a long-shaped film substrate 50 and has a pair of belt members 51 and 52 in a plurality of locations (three in the embodiment) in the longitudinal direction.

The belt members 51 and 52 are integrally provided at both ends of the film substrate 50 in the width direction, respectively, and are disposed so as to face each other. As described below, the belt members 51 and 52 make the first film member 46 and the second film member 47 to be integrated by engaging each other.

Figure 6:
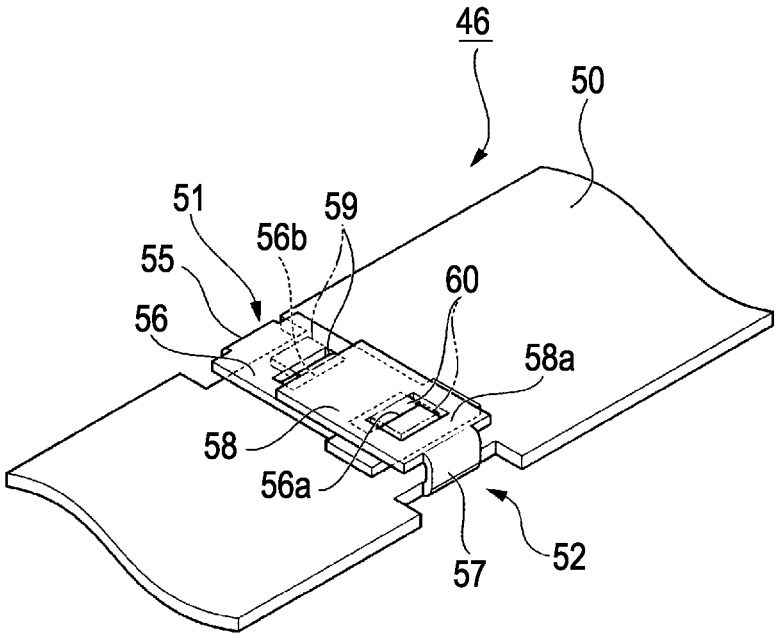
FIG. 6 is a view illustrating a configuration of a main portion of the cable holder.

The cable holder 45 holds a laminated body 40A in which the plurality of the flat cables 40 are laminated in a state where the laminated body 40A is sandwiched between the first film member 46 and the second film member 47 (see, FIG. 6).

The belt member 51 has a connection section 55 connected to the film substrate 50 and a body section 56 integrally provided on the connection section 55.

The belt member 52 has a connection section 57 connected to the film substrate 50, a body section 58 integrally provided on the connection section 57 and a convex section 59 protruding from the end portion of the body section 58.

The connection sections 55 and 57 may be folded at boundary portions with the film substrate 50. In addition, the body sections 56 and 58 may be folded at boundary portions with the connection sections 55 and 57. As described above, the belt members 51 and 52 are adapted to be disposed by being folded inwards the film substrate 50 at the boundary portions, respectively in a state of facing the surface of the film substrate 50.

The belt members 51 and 52 are adapted to be disposed on one side (the opposite side of the first film member 46) of the laminated body 40A by folding as described above. Accordingly, the belt members 51 and 52 may be engaged to each other so as to enclose the second film member 47 disposed on one side of the laminated body 40A (see, FIG. 6). The belt members 51 and 52 are also adapted to be fixed to the rear side (the opposite side of the laminated body 40A) of the second film member 47.

The cable holder 45 holds the laminated body 40A in a state where the laminated body 40A is sandwiched between the first film member 46 and the second film member 47, based on the configuration described above. In addition, the pair of the belt members 51 and 52 integrally formed on the first film member 46 are engaged each other so as to enclose the second film member 47 so that the first film member 46 and the second film member 47 can be integrally formed. In addition, since the first film member 46 according to the embodiment has the pair of the belt members 51 and 52 at three locations (a plurality of locations), integrity with the second film member 47 can be improved.

Hereinafter, configurations of the belt members 51 and 52 will be described in detail.

Figure 5A:
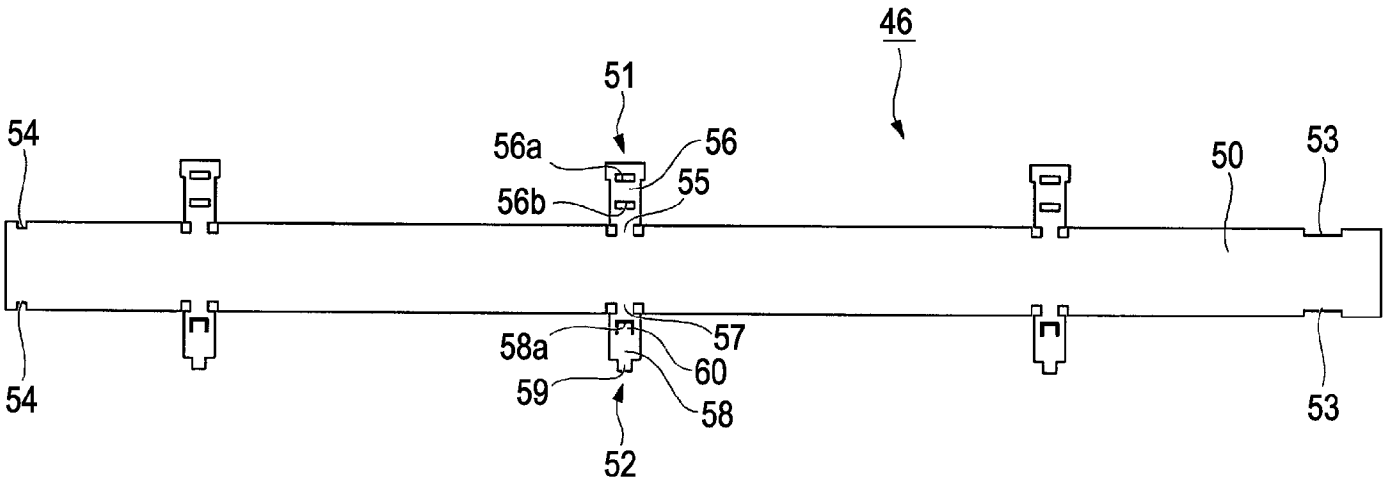
FIG. 5A is a plan view illustrating a configuration of a first film member and FIG. 5B is a plan view illustrating a configuration of a second film member.
Figure 5B:
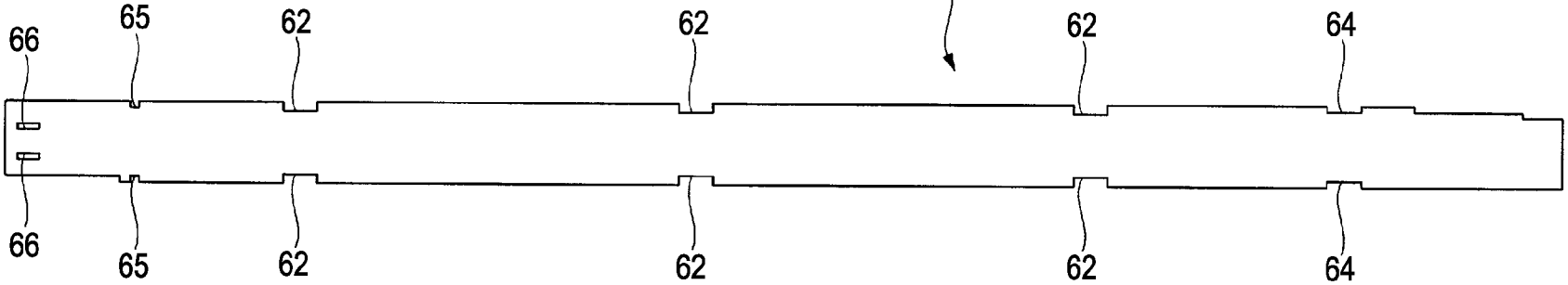

FIG. 5A is a plan view illustrating the configuration of the first film member 46 and FIG. 5B is a view illustrating the configuring of the second film member 47. In addition, FIG. 6 is a view illustrating a configuration of a main portion of the cable holder 45.

As illustrated in FIG. 5A, in the first film member 46, the connection sections 55 and 57 are formed in a state of entering the end of the film substrate 50 in the width direction. Thus, as illustrated in FIG. 4, the connection sections 55 and 57 can be prevented from being a structure that protrudes outside in the outline of the cable holder 45 when the connection sections 55 and 57 are folded. According to the configuration, even though the cable holder 45 is curved according to the movement of the carriage 30 and the shape thereof is changed, it is possible to prevent occurrence of a problem that the connection sections 55 and 57 come into contact with other parts inside the printer 1 because the connection sections 55 and 57 are not protruded outside the outline of the cable holder 45.

One end side of the second film member 47 configuring the cable holder 45 is fixed to the carriage 30 as described below (see, FIGS. 7A, 7B and 8A, 8B). The film substrate 50 has notches 54 having dimensions corresponding to a clip member 37 provided on a holding member 36 of the carriage 30 (see, FIGS. 7A and 7B).

In addition, notches 53 abutting a clip member 38 provided on the case body section 1A are formed in the end portion opposite side of the notches 54 of the film substrate 50.

Here, the laminated body 40A held in the cable holder 45 is configured by laminating the plurality (for example, three) of the flat cables 40 having the same outer diameter as each other. In addition, each of the flat cables 40 configuring the laminated body 40A has notches 40*a* corresponding to the connection sections 55 and 57. Here, the notches 40*a* corresponding to the connection sections 55 and 57 means that the notches 40*a* are formed in the same pitch as the arrangement pitch of the connection sections 55 and 57 in the belt members 51 and 52.

The width of the portion (a base section) in which the notches 40*a* are formed in the flat cables 40 is the same as the width of the portion (the base section) in which the connection sections 55 and 57 of the first film member 46 are formed. Accordingly, the notches 40*a* and the connection sections 55 and 57 are disposed in a state of being positioned, and as described above, when the connection sections 55 and 57 are folded, the connection sections 55 and 57 become a state of abutting both sides (the both side portions in the width direction) of the laminated body 40A. Accordingly, the connection sections 55 and 57 can function as a regulating section of the invention, and regulate the position of the both end portions of the laminated body 40A in the width direction.

In addition, the body section 56 of the belt member 51 has two cutout sections 56*a* and 56*b* formed along the longitudinal direction of the film substrate 50. The body section 58 of the belt member 52 has a U-shaped cutout 58*a* and a convex section 60 is formed at the center of the body section 58 by the cutout 58*a*. When the body section 56 is folded, the convex section 60 is able to rotate with respect to the body section 58 by the cutout 58*a*.

Thus, as illustrated in FIG. 6, the convex section 60 is capable of entering (engaging) the cutout section 56*a* of the body section 56 of the belt member 51. In addition, the convex section 59 of the belt member 51 is capable of entering (engaging) the cutout section 56*b* of the body section 56 of the belt member 51. As described above, the belt members 51 and 52 are locked to each other and can be integrated by engaging the convex sections 60 and 59 and the cutout sections 56*a* and 56*b*.

In addition, as illustrated in FIG. 5B, the second film member 47 is configured of a long-shaped film substrate 61 and a pair of notches 62 and 63 are formed in a plurality of locations (three locations in the embodiment) in the longitudinal direction thereof.

One end side of the second film member 47 configuring the cable holder 45 is fixed to the carriage 30 as described below, (see, FIGS. 7A, 7B and 8A, 8B). The film substrate 61 has the notches 65 having dimensions corresponding to the clip member 37 provided in the holding member 36 of the carriage 30 and openings 66 engaging protrusion sections 36*a* formed on the holding member 36 (see, FIGS. 7A and 7B).

In addition, notches 64 engaging the clip member 38 provided in the case body section 1A are formed in the end portion opposite side of the openings 66 in the film substrate 61.

The notches 62 and 63 are formed in positions corresponding to the positions of the formation of the pair of belt members 51 and 52 provided in the first film member 46. Here, positions corresponding to the positions of the formation of the belt members 51 and 52 mean that the notches 62 and 63 have the same pitch as the arrangement pitch of the belt members 51 and 52 in the first film member 46 and the second film member 47. The connection sections 55 and 57 of the belt members 51 and 52 abut the side surfaces of the notches 62 and 63, respectively.

As described above, the cable holder 45 can integrally hold the first film member 46 and the second film member 47 by engaging the cutout sections 56*a* and 56*b* formed on the belt member 51 and the convex sections 60 and 59 formed on the belt member 52, respectively.

In addition, the heights of the connection sections 55 and 57 are set to be greater than the thickness (a total thickness) of the laminated body 40A in which the plurality of the flat cables 40 are laminated. In the embodiment, since the belt members 51 and 52 are in a state where the second film member 47 is sandwiched on the laminated body 40A, the heights of the connection sections 55 and 57 are set to be greater than a total value of the thickness of the laminated body 40A and the second film member 47.

As described above, since the belt members 51 and 52 are fixed to the rear side (the opposite side of the laminated body 40A) of the second film member 47, the cable holder 45 holds the first film member 46 and the second film member 47 in a state where the first film member 46 and the second film member 47 are separated from each other by the height of the connection sections 55 and 57 which are greater than the thickness of the laminated body 40A.

Accordingly, the cable holder 45 is able to hold the laminated body 40A in the state where slight clearance is secured between the first film member 46 and the second film member 47 in the thickness direction of the laminated body 40A because the belt members 51 and 52 are engaged to each other.

Figure 7A:
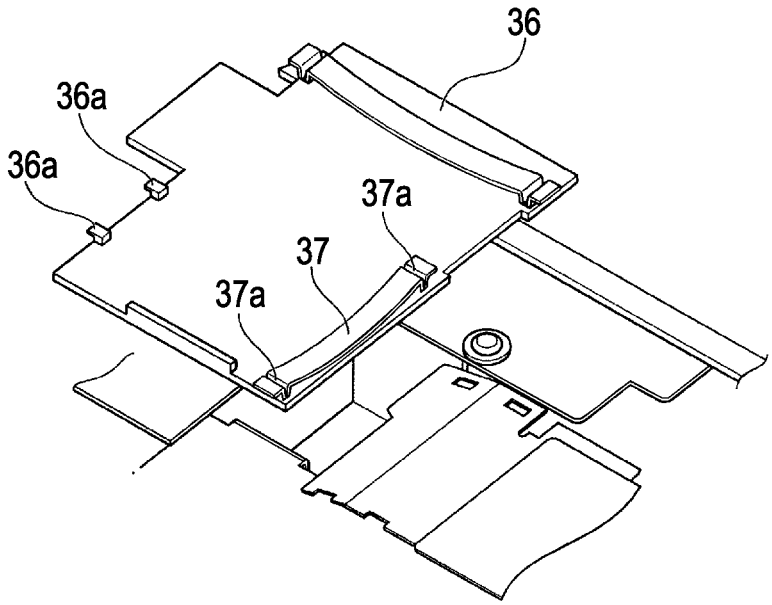
FIG. 7A is a view illustrating a configuration of a holding portion which holds one end side of the cable holder and FIG. 7B is a view illustrating a configuration of the cable holder one end side thereof is held in the cable holder.
Figure 7B:
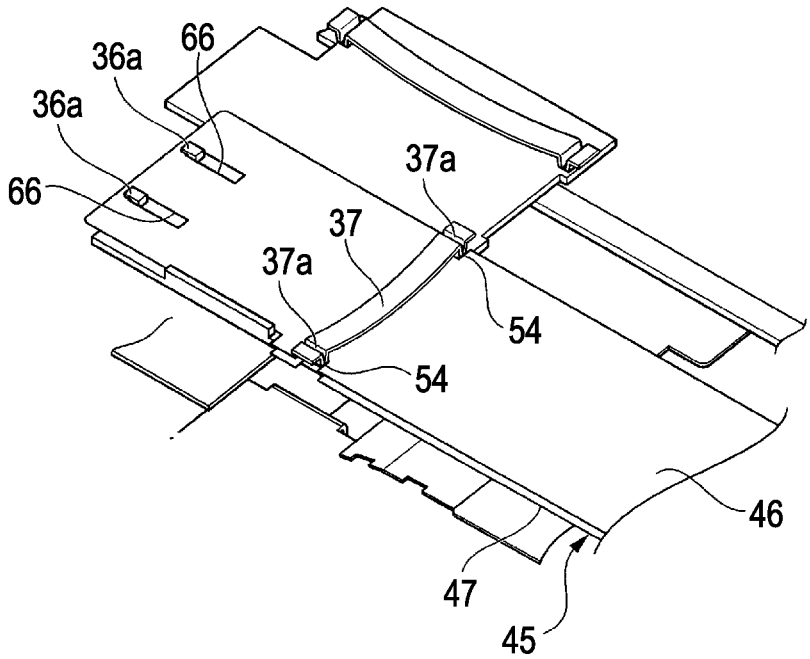

FIGS. 7A and 7B are views illustrating a configuration of a main portion of the holding portion of one end side of the cable holder 45 in the printer 1. In particular, FIG. 7A is a view illustrating a configuration of the holding portion which holds one end side of the cable holder 45 and FIG. 7B is a view illustrating a configuration of the cable holder of which one end side is held on the cable holder.

As illustrated in FIG. 7A, one end side of the cable holder 45 (the second film member 47) is held on the holding member 36 which comes into contact with the upper surface of the carriage 30. The clip member 37 pressing the cable holder 45 between the holding member 36 and the clip member is detachably attached to the holding member 36.

In addition, as illustrated in FIG. 7B, two protrusion sections 36*a* holding the second film member 47 by fitting the notches 64 formed in the second film member 47 of the cable holder 45 are formed on the holding member 36. The openings 66 is hooked in the protrusion sections 36*a* so that the second film member 47 is preferably fixed to the holding member 36.

The clip member 37 may be detached and engaged by disengaging of both end sections 37*a* in the longitudinal direction with respect to opening sections (not illustrated) provided in the holding member 36. The clip member 37 is fixed to the holding member 36 in a state where the both end sections 37*a* are fitted in the notches 54 and 65 formed in the first film member 46 and the second film member 47. In order to correspond to the dimensions of the both end sections 37*a* of the clip member 37, the positions of the notches 54 and 65 are restrained by the both end sections 37*a* of the clip member 37 so that the second film member 47 is fixed to the holding member 36.

The clip member 37 has a curved shape that is curved in an arc shape towards the center from the both end sections 37*a* and the center portion abuts the holding member 36 in a state where the both end sections 37*a* are engaged to the holding member 36, based on the configuration.

The clip member 37 can reliably hold the one end side of the cable holder 45 with respect to the holding member 36.

Figure 8:
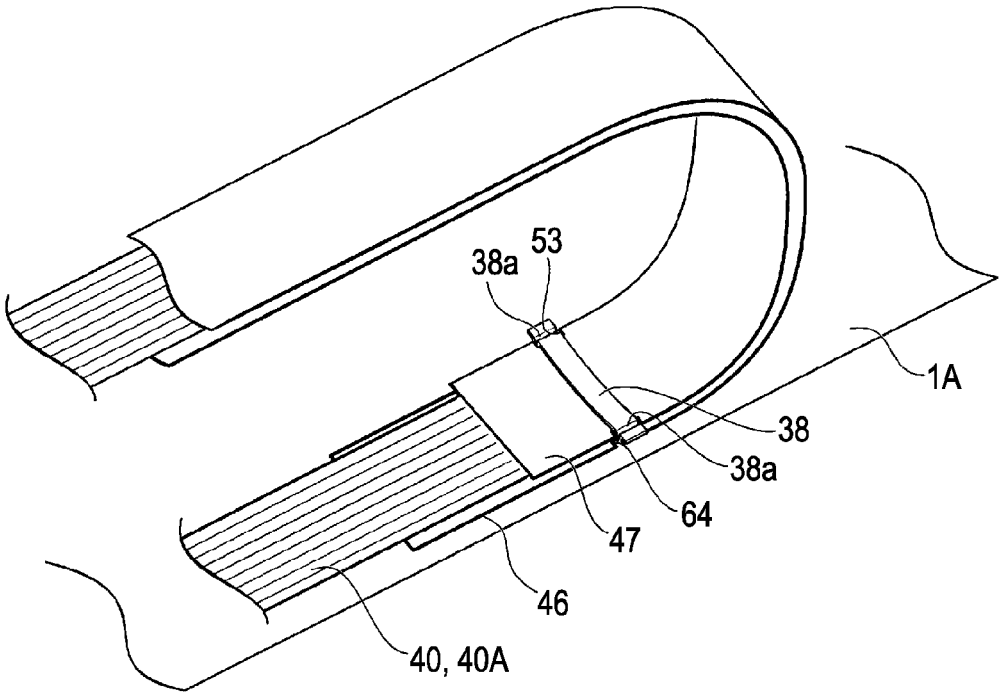
FIG. 8 is a view illustrating a configuration of the cable holder of which the other end side is held on the cable holder.

FIG. 8 is a view illustrating a configuration of a main portion of the holding portion of the other end side of the cable holder 45 in the printer 1. In particular, FIG. 8 is a view illustrating a configuration of the cable holder of which the other end side is held on the cable holder.

As illustrated in FIG. 8, the other end side of the cable holder 45 (the second film member 47) is held on the case body section 1A configuring the apparatus body of the printer 1. The clip member 38 pressing the cable holder 45 with the case body section 1A is detachably attached to the case body section 1A.

The clip member 38 is detachably provided by disengaging of the both end sections 38*a* in the longitudinal direction with respect to the opening section (not illustrated) provided in the case body section 1A.

The clip member 38 is fixed to the case body section 1A in a state where the both end sections 38*a* are fitted in the notches 53 and 64 formed on the first film member 46 and the second film member 47. In particular, in the embodiment, the notches 53 and 64 are pressed by the clip member 38 in a state where the up and down is reversed by folding the cable holder 45 by 180°. The clip member 38 has a curved shape that is curved in an arc shape towards the center from the both end sections 38*a*. In addition, the both end sections 38*a* are engaged to the case body section 1A so that the center portion abuts the case body section 1A. Accordingly, the clip member 38 is in a state of abutting the first film member 46.

The width of a portion in which the notches 53 and 64 are formed in the cable holder 45 is set to be the same as the dimensions of the both end sections 38*a* of the clip member 38. Thus, the position of the cable holder 45 in the width direction is restricted by the both end sections 38*a* of the clip member 38.

Meanwhile, the lengths of the notches 53 and 64 are set to be greater than the dimensions of the both end sections 38*a* of the clip member 38. Thus, the other end side of the cable holder 45 is configured such that the notches 53 and 64 in the length direction can slide with respect to the both end sections 38*a* of the clip member 38. Accordingly, the other end side of the cable holder 45 is fixed to the case body section 1A in a state of being movable along the longitudinal direction.

Subsequently, the operation of the printer 1 will be described. In the description below, the operation of the carriage 30 is mainly described which obtains the advantage of the cable holder 45 that is a characteristic portion of the printer 1 according to the embodiment when the printing process is performed.

When the printer 1 performs the printing process, the controller 100 drives the printing head 31 and the ink is ejected on the roller pair supplied from the paper feeding section 2. The controller 100 operates the carriage driving device during the printing process and makes the carriage 30 to be scanned along the rail 35 so that the ink can be ejected on the entire roller pair in the width direction.

As illustrated in FIGS. 7A and 7B, since one end side of the cable holder 45 is fixed to the carriage 30 side, the position of one end side changes with respect to the other end side which is held on the case body section 1A according to the movement of the carriage 30 during the printing process. The cable holder 45 according to the embodiment has a shape that is folded in the middle thereof by 180° so that the position of the bending section 42 is changed according to the movement of the carriage 30.

At this time, since the cable holder 45 holds a state where the position of the laminated body 40A (the plurality of the flat cables 40) in the width direction is regulated, deviation of the position of the plurality of the flat cables 40 in the width direction according to the movement of the carriage 30 can be prevented. Accordingly, since the deviation of the position of the wiring which is formed in each of the flat cables 40 does not occur, occurrence of the crosstalk can be prevented. Accordingly, the flat cables 40 can stably perform the communication of the electric signal and supply the power to the printing head 31 side.

Here, since the laminated body 40A held on the cable holder 45 is configured by laminating the plurality of the flat cables 40, difference in an inner race and an outer race is caused between the flat cables 40 which are disposed in the inside or the outside of the bending section 42. Here, the difference in the inner race and the outer race means that the cable holder 45 of the inside of the bending section 42 has a small curvature of the bending section 42 compared to the cable holder 45 of the outside thereof.

Since the cable holder 45 according to the embodiment is disposed in a state where the second film member 47 secures an interval with respect to the first film member 46, which is greater than the total thickness of the laminated body 40A configured of the plurality of the flat cables 40, an interval can be generated between the laminated flat cables 40 when the plurality of the flat cables 40 are bent during the scanning of the recording head 31. There is no force to cause regulation on the long side direction of the flat cables 40 by the cable holder 45 during bending.

Accordingly, even though difference in the inner race and the outer race between the laminated flat cables 40 occurs, since restriction between each of the flat cables 40 does not occur in the long side direction, the flat cables 40 can be bent without distortion being caused.

In addition, since the cable holder 45 is fixed to the case body section 1A in a state where the other end side thereof is movable along the longitudinal direction, the vibration occurred due to the bending movement can be suppressed to transmit to the recording head side compared to a configuration in which the cable holder 45 itself is completely fixed.

According to the printer 1 of the embodiment described above, the communication of the electric signal and the supply of the power are stably carried out, and reliability, in which occurrence of failure of the bending operation of the flat cable 40 is prevented, is increased.

According to the printer 1 of the embodiment, the pair of belt members 51 and 52 are engaged, respectively so that the first film member and the second film member can be easily integrated. In addition, since the belt members 51 and 52 are integrally formed to the film substrate 50 configuring the first film member 46, the number of the parts is reduced and assembling characteristics can be improved, and low cost can be realized.

In addition, the invention is not limited to the configuration of the above embodiment and may be appropriately changed in a range without departing the gist of the invention.

For example, the above embodiment is exemplified in which the belt members 51 and 52 are integrally formed with the first film member 46, however, a configuration may be employed in which the belt members 51 and 52 are integrally formed with the second film member 47.

The entire disclosure of Japanese Patent Application No. 2012-095852, filed Apr. 19, 2012 is expressly incorporated by reference herein.

What is claimed is:

1. A recording apparatus which performs recording by a recording head mounted on a carriage which is capable of scanning with respect to a recording medium, the recording apparatus comprising:

a flexible wiring substrate of which one end is connected to the recording head side and which transmits an electric signal between a controller performing control of the recording head and the recording head; and a holding member which holds a plurality of the flexible wiring substrates in a state of being laminated, wherein the holding member includes:

a regulating section which regulates both end portions of the plurality of the flexible wiring substrates in the width direction in a state of being laminated, a first film member that has flexibility and a long shape and that is disposed on one side of the plurality of the flexible wiring substrates in the thickness direction in a state of being laminated, and a second film member which that has flexibility and a long shape and that is disposed on the other side in the thickness direction, wherein an interval is secured between the first film member and the second film member that is greater than a total thickness of the plurality of the flexible wiring substrates, wherein a longitudinal length of the first film member in a longitudinal direction is the same as a longitudinal length of the second film member in the longitudinal direction.

2. The recording apparatus according to claim 1, wherein the regulating section is formed in any of the first film member or the second film member.

3. The recording apparatus according to claim 2, wherein the regulating section is configured of a pair of belt members, and wherein the pair of the belt members are configured to engage with each other such that the first film member is integrated with the second film member.

4. The recording apparatus according to claim 1, wherein the flexible wiring substrates come into contact with the recording head in a state of having a bending section which is bent in the thickness direction.

5. The recording apparatus according to claim 4, wherein the flexible wiring substrates are bent in the vertical direction in bending section.

6. The recording apparatus according to claim 1, wherein the first film member and the second film member configure a film body by sandwiching the flexible wiring substrates, and wherein the film body is attached to a recording apparatus body in a state where one end side thereof fixed to the carriage and the other end side thereof is movable along the longitudinal direction of the film body.

* * * * *